US007164092B2

(12) United States Patent
Kawano

(10) Patent No.: US 7,164,092 B2
(45) Date of Patent: Jan. 16, 2007

(54) PUSH SWITCH

(75) Inventor: Kenji Kawano, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 1 day.

(21) Appl. No.: 11/146,192

(22) Filed: Jun. 6, 2005

(65) Prior Publication Data

US 2005/0274593 A1 Dec. 15, 2005

(30) Foreign Application Priority Data

Jun. 10, 2004 (JP) ..... 2004-172695

(51) Int. Cl.
*H01H 9/00* (2006.01)

(52) U.S. Cl. ..... 200/310; 200/314

(58) Field of Classification Search ..... 200/310–314, 200/341–345, 293
See application file for complete search history.

(56) References Cited

U.S. PATENT DOCUMENTS 5,430,262 A * 7/1995 Matsui et al. ..... 200/5 A
5,584,384 A * 12/1996 Mizuno et al. ..... 200/524
5,669,489 A * 9/1997 von Ende ..... 200/570
5,803,242 A * 9/1998 Takano et al. ..... 200/530
6,046,420 A * 4/2000 DeMoss ..... 200/534
6,998,553 B1 * 2/2006 Hisamune et al. ..... 200/336

FOREIGN PATENT DOCUMENTS

JP 5-55426 7/1993

* cited by examiner

*Primary Examiner*—Michael Friedhofer
*Assistant Examiner*—Lisa Klaus
(74) *Attorney, Agent, or Firm*—Brinks Hofer Gilson & Lione

(57) ABSTRACT

A slider is provided with projections. Each projection is formed with tapered surfaces. A casing is provided with concave portions having the same shape as the projections. During the return of an operating body, the slider ascends while being inclined, and the slider stands upright as the tapered surface of the projection and the tapered surface of the concave portion of the casing slide on each other. Then, each projection is fitted into the corresponding concave portion, thereby positioning the slider.

5 Claims, 5 Drawing Sheets

PUSH SWITCH

This application claims the benefit of priority to Japanese Patent Application No. 2004-172695 filed on Jun. 10, 2004, herein incorporated by reference.

BACKGROUND OF THE INVENTION

1. Field of the Invention

The present invention relates to a push switch which prevents an impact noise from being generated during the return of a slider after the slider is pressed.

2. Description of the Related Art

A push switch is publicly known in Japanese Unexamined Utility Model Registration Application Publication No. 5-55420 and shown in FIGS. 9 and 10. In the push switch, an operating member is pressed to bring a movable contact into contact with and separated from a fixed contact, and the movable contact and the fixed contact are accommodated in a casing. If the pressing is released by a return member, these contacts return to their initial positions. Section lines in FIGS. 9 and 10 pass through a front leg and a rear leg which will be described later.

In the drawings, reference numeral 20 denotes a push button switch of a hysteresis mechanism. The push button switch 20 is constructed such that an operating body 22 is mounted on a casing 21, and the operating body 22 is depressed to allow switching operation. The casing 21 of the push button switch 20 is formed with a rectangular bulging portion 23, and the operating body 22 is mounted in the bulging portion 23. That is, sliding portions 24 are suspended from the four corners of the operating body 22, and the sliding portions 24 are formed so as to slide vertically inside the four corners of the casing 21. Therefore, the operating body 22 is mounted to be vertically movable with respect to the casing 21.

A coil spring 25 is fitted into the middle of the rear surface of the operating body 22 and is suspended from the surface. A membrane switch 26 is provided beneath the bottom of the casing 21. A click rubber 27 is provided between the coil spring 25 and the membrane switch 26 such that a head of the click rubber 27 is fitted to a lower portion of the coil spring 25. A pressing portion 28 protruding from the other side of the head of the click rubber 27 is positioned above contacts 29 and 30 of the membrane switch 26.

On the other hand, between a pair of the sliding portions 24 provided back and forth (the front side of the drawing is forth, and the rear side of the drawing is back), a front leg 31 and a rear leg 32 are suspended. Similarly, a front leg 31 and a rear leg 32 are suspended between another pair of sliding portions 24, and lower ends of the front legs 31 project outward to form stoppers 33. Lower ends of the rear legs 32 are provided with projections 34. The projection 34, as shown in FIG. 10, is formed in the shape of a taper which is widened outward from the top toward the bottom. Further, an upper edge 35 of the bulging portion 23 of the casing 23 is stepped. In addition, the stoppers 33 protrude in a direction substantially orthogonal to the legs 31 to be locked to the upper edge 35 of the bulging portion 23.

The projections 34 formed at the rear legs 32, as shown in FIG. 10, are widened from locations slightly above the stoppers 33, and the rear legs 32 are made narrower than the front legs 31. Therefore, the rear legs 32 have a larger elastic force than the front legs 31. That is, the front legs 31 are not bent and the operating body 22 is not separated from the casing 21 unless the operating body 22 is intentionally detached from the casing. On the other hand, the lower edge of the click rubber 27 is provided with an outwardly protruding seat 36. The seat 36 is formed so that the legs 31 can be seated thereon.

When the operating body 22 is pressed, the coil spring 25 urges the click rubber 27 with the decent of the operating body 22, and the pressing portion 28 of the click rubber 27 presses the contact 29 of the membrane switch 26. Accordingly, the contact 29 contacts the contact 30. At this time, the legs 31 are seated on the seat 36 of the click rubber 27, which prevents generation of an impact noise of the legs 31.

When the operating body 22 is released from pressing, the operating body 22 returns to its original uppermost position by an elastic forces of the click rubber 27 and the coil spring 25. At this time, before the stoppers 33 provided at the front legs 31 reach the upper edge 35 of the casing 21, the projections 34 of the rear legs 32 contact the upper edge 35. As the operating body 22 ascends, the legs 32 are bent and pressed against the upper edge 35 of the casing 21.

When the operating body 22 ascends, the stoppers 33 are locked to the upper edge 35 of the casing 21 to stop the ascent of the operating body 22. Accordingly, the pressing of the projections 34 against the upper edge 35 of the casing 21 relieves an impact caused between the stoppers 33 and the casing 21 when the ascent of the operating body 22 stops, which prevents generation of an impact noise.

In such a conventional push switch, before the stoppers 33 of the front legs 31 reach the upper edge 35 of the casing 21, the projections 34 of the rear legs 32 contact the upper edge 35. Also, as the operating body 22 ascends, the legs 32 are bent and pressed against the upper edge 35 of the casing 21. Moreover, when the operating body 22 ascends, the stoppers 33 are locked to the upper edge 35 of the casing 21 to stop the ascent of the operating body 22. Accordingly, the pressing of the projections 34 against the upper edge 35 of the casing 21 relieves the impact caused between the stoppers 33 and the casing 21 when the ascent of the operating body 22 stops, which prevents generation of an impact noise.

However, since the vertical movement of the operating body 22 is guided by the casing 21, the tapered surfaces of the projections 34 of the operating body 22 come into collision with the upper edge 35 of the casing 21, which is not enough to weaken the noise.

Also, the operating body 22 in its non-operative state is positioned by the flat surfaces of the stoppers 33 and the upper edge 35 after the legs 32 are elastically deformed, which requires elasticity to be given to the legs 32. Therefore, the push switch needs to be designed in consideration of the spring pressure of the return members (the click rubber 27 and the coil spring 25), the strength of the legs 32, etc. There are also limitations to the adjustment of the elasticity.

It is an object of the present invention to provide a push switch which prevents generation of an impact noise during the return of an operating body which has been pressed and which has no chattering in a non-operative state.

SUMMARY OF THE INVENTION

In order to achieve the above-described object, the push switch of the present invention includes an operating body having an operating body regulating portion, a casing having a guide portion for holding the operating body in a vertically movable manner, and a casing regulating portion for regulating movement of the operating body in a direction opposite to a pressed and moved direction of the operating body by abutting the operating body regulating portion, a return member which gives an elastic force so as to make the operating body regulating portion abut on a casing regulating portion, fixed and movable contact which are brought into contact with or separated from each other according to a pressing operation and a releasing operation of the operating body, a first tapered surface provided in at least one of the operating body and the casing and inclined from an operating direction of the operating body and a second tapered surface parallel to the first tapered surface, and a gap provided between the casing and the operating body for allowing the operating body to move. During the return of the operating body, the operating body is abutted against and guided by the first tapered surface and the second tapered surface, and then the operating body regulating portion abuts on the casing regulating portion to regulate the position of the operating body in its operating direction.

By the above construction, since the operating body slides while abutting the first and second tapered surfaces, an impact noise caused by bouncing is weakened. In addition, since the operating body regulating portion abuts on the casing regulating portion to regulate the location of the operating body, the operating body can be easily positioned.

In the above-described push switch of the present invention, an operating portion protrudes from the middle of the operating body, and the first and second tapered surfaces face each other with the operating portion therebetween.

By the above construction, since the tapered surfaces are provided to be separated from each other, the sliding becomes more stable.

In the push switch of the present invention, at least one of the operating body regulating portion and the casing regulating portion is provided continuously with the first and second tapered surfaces.

By the above construction, the structure for preventing the noise from being generated during the return of the operating body and the structure for positioning the operating body can be simplified.

In the push switch of the present invention, the first tapered surface and the operating body regulating portion of the operating body or the casing regulating portion of the casing defines a V-shaped tapered surface. The operating body and the casing abut on parallel tapered surfaces on one side, and then abut on parallel tapered surfaces on the other side.

By the above construction, although the center of the projection is shifted from the center of the concave portion on the V-shaped tapered surfaces to some degree when the projection is fitted into the concave portion, noise can be prevented from being generated during the return of the slider, and the operating body can be surely positioned in plan view.

In the push switch of the present invention, in plan view, a V-shaped tapered surface is defined on a surface orthogonal to the V-shaped tapered surface to form a quadrangular pyramid surface.

By the above construction, although the center of the projection is shifted from the center of the concave portion in any directions on the V-shaped tapered surfaces to some degree when the projection is fitted into the concave portion, noise can be prevented from being generated during the return of the slider, and the operating body can be surely positioned in plan view.

According to the present invention, since the sliding occurs in contact between the first and second tapered surfaces, the noise caused by the bouncing is weakened. Since the operating body regulating portion abuts on the casing regulating portion to regulate the position of the operating body, the operating body can be surely positioned.

DESCRIPTION OF THE PREFERRED EMBODIMENTS

Hereinafter, push switches according to preferred embodiments of the present invention will now be described with reference to the accompanying drawings.

First Embodiment

Figure 1:
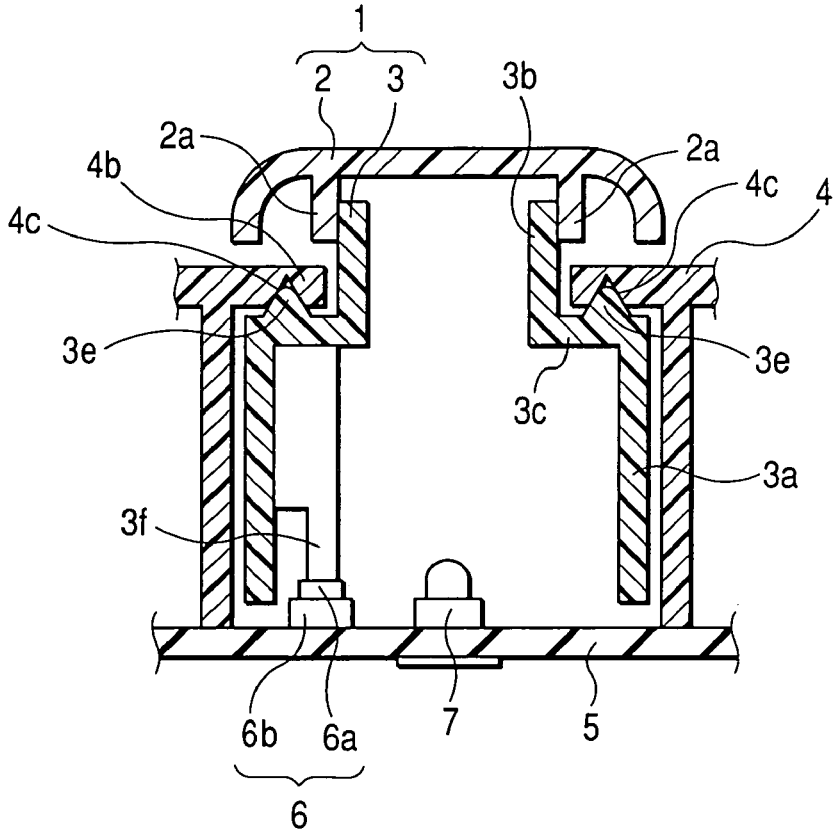
FIG. 1 is a sectional view showing the state where a push switch related to a first embodiment of the present invention is not pressed.
Figure 2:
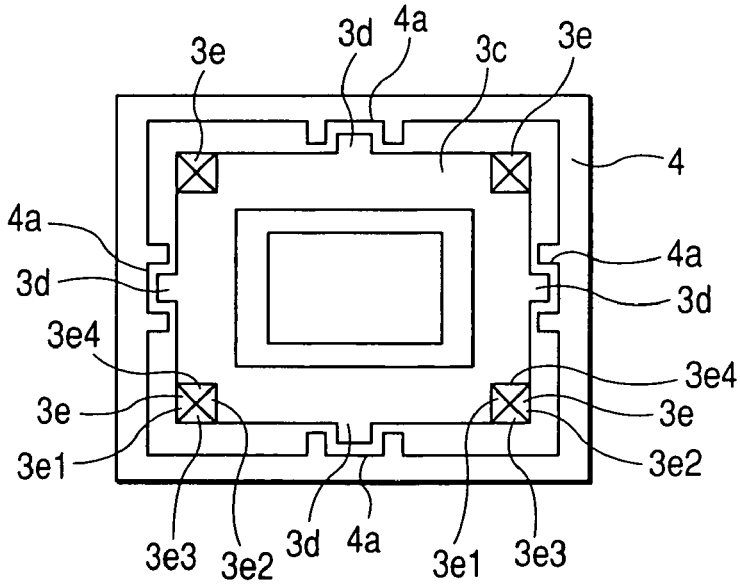
FIG. 2 is a transverse sectional view showing the push switch shown in FIG. 1.
Figure 3:
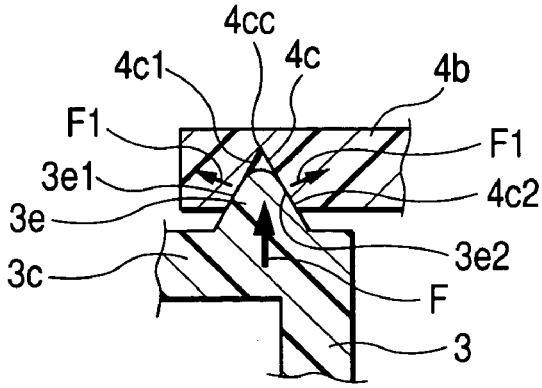
FIG. 3 is an enlarged sectional view showing main parts of the push switch in FIG. 1.
Figure 4:
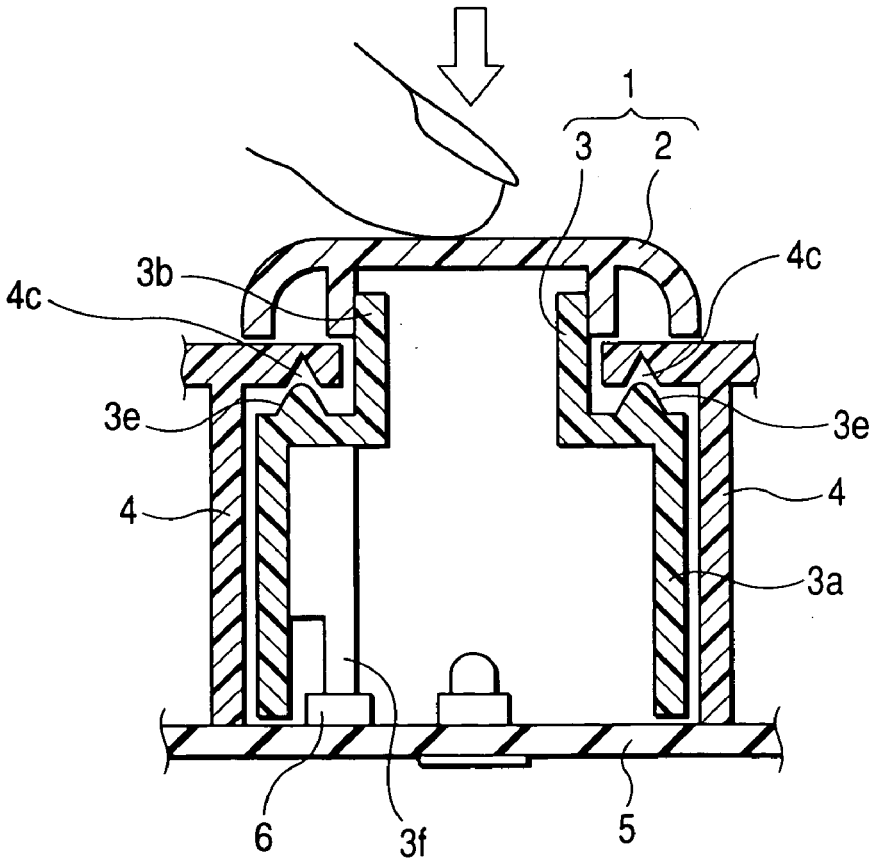
FIG. 4 is an explanatory view showing the operation state of the push switch shown in FIG. 1.
Figure 5:
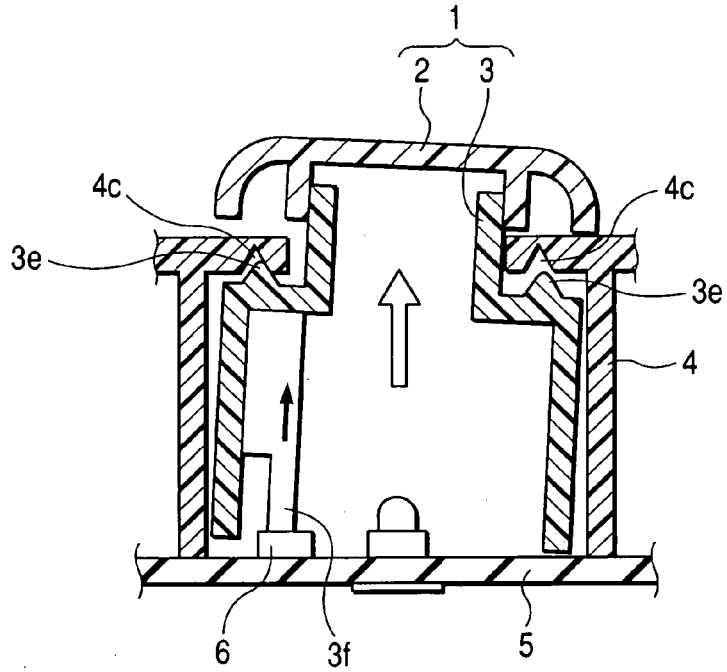
FIG. 5 is an explanatory view showing the operation state of the push switch shown in FIG. 1.
Figure 6:
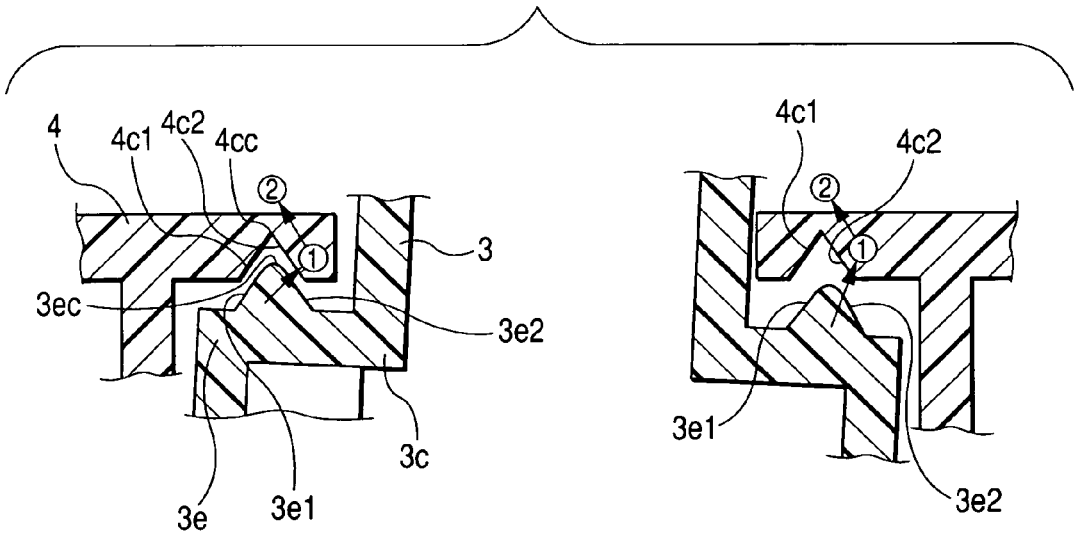
FIG. 6 is an explanatory view showing the operation which prevents generation of an impact noise.
Figure 7:
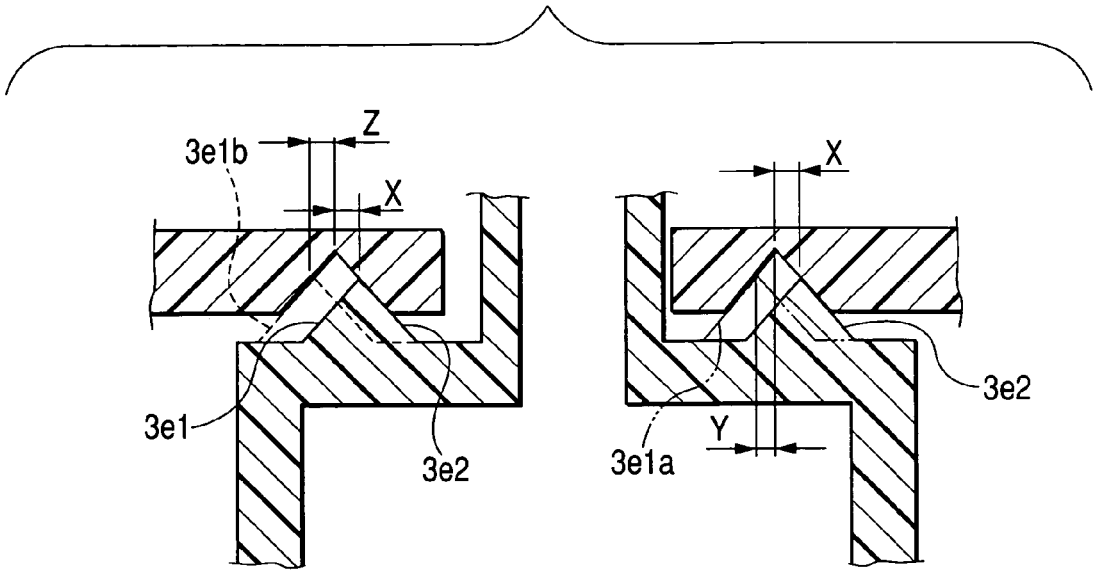
FIG. 7 is an explanatory view showing the operation of the push switch according to the first embodiment.

FIG. 1 is a sectional view showing the state where a push switch related to a first embodiment of the present invention is not pressed. FIG. 2 is a transverse sectional view showing the push switch shown in FIG. 1. FIG. 3 is an enlarged sectional view showing main parts of the push switch in FIG. 1. FIG. 4 is an explanatory view showing the operation state of the push switch shown in FIG. 1. FIG. 5 is an explanatory view showing the operation state of the push switch shown in FIG. 1. FIG. 6 is an explanatory view showing the operation which prevents generation of an impact noise. FIG. 7 is an explanatory view showing the operation of the push switch according to the embodiment. In addition, the inclination and clearance of an operating body are indicated larger than an actual size in the drawings.

In the push switch of the present embodiment, as shown in FIGS. 1 to 7, reference numeral 1 denotes the operating body as a whole, the operating body 1 is composed of a knob 2 and a slider 3 which are respectively molded from synthetic resin. The knob 2 is molded in the shape of a box whose bottom surface is opened, and engaging projections 2*a* are formed on the middle of the lower surface of a top plate. On the other hand, the slider 3 includes a slider body 3*a* molded in the shape of a rectangular frame whose top and bottom surfaces are opened, a knob attaching portion 3*b* having a smaller diameter formed at an upper portion of the slider body 3*a*, and a stepped portion 3*c* provided between the slider body 3*a* and the attaching portion 3*b*. The middle of each of all the side walls of the slider body 3*a* is provided with a vertically extending projection strip 3*d*. Quadrangular pyramid-shaped projections 3*e* are respectively provided at four corners of the stepped portion 3*c* of the slider 3. Since each projection 3*e* is quadrangular pyramid-shaped, tapered surfaces 3*e*1 (operating body regulating portion) and 3*e*2 having a V-shaped section are formed. Further, in an arrangement in a direction orthogonal the above tapered surfaces in plan view, tapered surfaces 3*e*3 and 3*e*4 having a V-shaped section are formed. Moreover, the projections 3*e* are respectively disposed at four spots around the attaching portion 3*b* to which the knob 2 is attached, and the tapered surfaces 3*e*1 of the respective projections 3*e* are set parallel to each other. Similarly, the tapered surfaces 3*e*2, 3*e*3 and 3*e*4 are respectively set parallel to each other. The vicinity of one side of the interior of the slider body 3*a* (left side in FIG. 1), is provided with a driving portion 3*f* formed of a plate piece whose lower end is made narrower than the other portion. The driving portion 3*f* is adapted to press down a switch portion 6. The knob 2 and the slider 3 are joined to each other and integrated into one body by fitting the attaching portion 3*b* into the engaging projection 2*a*.

Reference numeral 4 denotes a casing. The casing 4 is placed on and fixed to a predetermined position of a printed board 5 by proper means, such as welding. Every inner lateral surface of the casing 4 is provided with a guide groove 4*a* (guide portion) composed of a pair of vertical projection strips. As the projection strip 3*d* moves along the inside of the guide groove 4*a*, the slider 3 and the knob 2 integral with the slider 3 are guided to move vertically with respect to the casing 4. Quadrangular pyramid-shaped concave portions 4*c* are respectively provided at positions corresponding to the projections 3*e* of the slider 3 on the bottom surface of a top plate 4*b* having an opening of the casing 4. Thus, in a state of non-operation (FIG. 1), the projections 3*e* are fitted into the corresponding concave portions 4*c* and positioned therein. In each concave portion 4*c*, tapered surfaces 4*c*1 (casing regulating portion), 4*c*2, 4*c*3 and 4*c*4 are formed to face the above-described tapered surfaces 3*e*1, 3*e*2, 3*e*3 and 3*e*4 of each of the projections 3*e*. In the state of FIG. 1, the tapered surface 3*e*1 of the projection 3*e* is formed to have substantially the same shape as the tapered surface 4*c*1 of the concave portion 4*c* so that the tapered surfaces engage each other.

Incidentally, a clearance exists between the lateral surface of the slider body 3*a* and the inner lateral surface of the casing 4 so that the slider body 3*a* can be smoothly pressed.

Reference numeral 6 denotes a switch portion. The switch portion 6 includes, for example, a tact switch and is provided at a position shifted from the center of the knob 2. The switch portion 6 is composed of a tab 6*a*, an elastic movable contact (not shown but equivalent to a return member) provided beneath the tab 6*a* and made of a conductive material, two fixed contacts (both not shown) formed at an inner bottom surface and a case 6*b*. The switch portion 6 has its terminal fixed to a mounting hole or a connecting pattern formed in the printed board 5 by soldering, etc. Also, the tab 6*a* is pressed or released by the driving portion 3*f* of the slider body 3*a* so that the movable contact is brought into contact with and separated from the two fixed contacts.

In addition, reference numeral 7 denotes a lamp for illuminating an illuminating display portion of the knob 2. For convenience of illuminating, the lamp 7 is disposed just below the center of the knob 2 in plan view.

Next, the operation of the push switch will be described with reference to FIGS. 1 to 6. In a non-operative state of the operating body 1 (the slider body 3*a*), as shown in FIG. 1, the slider body 3*a* is urged upward in the casing 4 by an elastic force of the movable contact of the switch portion 6. In this case, as shown in FIG. 3, the projection 3*e* of the slider 3 abuts on the concave portion 4*c* and is fitted into each of the concave portion 4*c* of the casing 4. At this time, an elastic force F is divided into partial forces F1 and F1 which act on the V-shaped tapered surfaces 4*c*1 and 4*c*2 from the projection 3*e* (the partial force F is also applied to the other tapered surfaces 4*c*3 and 4*c*4 disposed orthogonal to these tapered surfaces). In FIG. 1, since the movement of the operating body 1 in left and right directions is regulated (since the projection 3*e* and the concave portion 4*c* are quadrangular pyramidal in the embodiment, the movement of the operating body in the direction orthogonal to the sheet surface is also regulated), the operating body 1 is positioned without chattering in a direction orthogonal to the operating direction. Each projection strip 3*d* of the slider 3 is located inside the guide groove 4*a* of the casing 4. A clearance exists between the lateral surface of the slider 3 and the inner lateral surface of the casing 4, and between the projection strip 3*d* and the guide groove 4*a*.

When the operating body 1 is pressed in the state of FIG. 1, the operating body is pressed without being caught by the virtue of the existence of the clearance. Thus, as shown in FIG. 4, the driving portion 3*f* of the slider 3 gradually presses the tab 6*a* of the switch portion 6, then the movable contact contacts the fixed contacts, and then the switch is turned ON.

Next, if the operating body 1 is released from pressing in the state of ON shown in FIG. 4, the slider 3 (the operating body 1) is urged upward via the driving portion 3*f* by the tab 6*a* of the switch portion 6. At this time, the switch portion 6 pushes up the driving portion 3*f* in the vicinity of the left end of the slider 3, and a clearance exists as described above. Thus, the slider 3 is pushed up while being inclined to the right as shown in FIG. 5. Accordingly, a leading end 3*ec* of the left projection 3 of the slider 3 is shifted from a bottom center 4*cc* of the concave portion 4*c* to the right, the right tapered surface 3*e*2 of the projection 3*e* abuts on the right tapered surface 4*c*2 of the concave portion 4*c* (a process to a circled number 1 shown in FIG. 6). Then, while both the projections slide on the tapered surfaces, the slider 3 moves in the left direction (a process to a circled number 2 shown in FIG. 6), and then the slider 3 inclined to the right moves to be straightened (the state in FIG. 1).

Hereinafter, the above operation will now be described in detail.

In the present embodiment, the distances between adjacent projections 3*e* (between the right and left projections or between the upper and lower projections in FIG. 2) are set to be approximately equal to the distances between the concave portions 4*c* which face the adjacent projections.

Therefore, in a case in which the center of the projection 3*e* is shifted from the center of the concave portion 4*c* as shown in FIG. 6, when the tapered surface 3*e*2 of the left projection 3*e* contacts the tapered surface 4*c*2 of the left concave portion 4*c*, the tapered surface 3*e*2 of the right projection 3*e* parallel to the above tapered surfaces abuts on the tapered surface 4*c*2 of the right concave portion 4*c*. In this state, a space is defined which enables both the projections 3*e* to move in the left direction (in the direction indicated by a circled number 2). Therefore, the slider can move smoothly in the left direction, which reduces an abnormal noise.

Next, the reason why the operating body is constructed as such will be described in detail with reference to FIG. 7. In FIG. 7, a solid line indicates a case in which the distance between the adjacent projections equal to that between the concave portions. A two-dotted line indicates a case in which the interval between the adjacent projections is excessively smaller than the amount X of deviation from the center (in FIG. 7, a case in which Y is over zero). A broken line indicates a case in which the interval between the adjacent projections is excessively larger than the amount X of deviation from the center (in FIG. 7, a case in which that Z is over zero). In the case in which the interval between the adjacent projections is excessively smaller than the amount X of deviation from the center, the right tapered surface 3*e*2 of the left projection 3*e* and a left tapered surface 3*e*1 a of the right projection 3*e* abut on the tapered surfaces of the concave portion. If this occurs, the slider 3 hardly continues to move, and thus the slider 3 stops once. Therefore, a loud noise is likely to be generated. In addition, if the interval between the adjacent projections is excessively larger than the amount X of deviation from the center, the tapered surface 3*e*1*b* of the left projection 3*e* and the tapered surface 3*e*2 of the right projection 3*e* respectively abut on the tapered surface 4*c*1 of the left concave portion 4*c* and the tapered surface 4*c*2 of the right concave portion 4*c*, which causes the same problem.

In the present embodiment, in order to prevent the possibility that such a case occurs, the parallel tapered surfaces of the adjacent projections respectively abut on the corresponding parallel surfaces of the concave portions which face the projections. To describe in detail with reference to FIG. 6, since the slider 3 slides in a state where the tapered surface 3*e*2 is in contact with the tapered surface 4*c*2, even when the tapered surface 3*e*2 abuts on the tapered surface 4*c*2, they slide on each other without collision, by which an impact noise caused by bouncing is lessened. Further, since the slider 3 slides on the tapered surfaces 3*e*2 and 4*c*2 from the circled number 1 to the circled number 2, the ascending speed (moving speed) of the slider 3 can be decreased. Even in the state of FIG. 1, that is, when the tapered surface 3*e*1 and the tapered surface 4*c*1 abut on each other and are positioned, generation of an impact noise can be prevented. In addition, as the left and right tapered surfaces 3*e*1 and 3*e*2 of the right projection 3*e* also abut on the left and right tapered surfaces 4*c*1 and 4*c*2 of the right concave portion 4*c*, the partial force F1 is applied to position the projection 3*e* in the concave portion 4*c*, as shown in FIG. 3, and then the slider 3 returns to the non-operative state of FIG. 1.

Meanwhile, in the present embodiment, the tapered surface 4*c*2 of the left concave portion 4*c* or the tapered surface 3*e*2 of the left projection 3*e* is equivalent to a first tapered surface. Also, the tapered surface 3*e*2 of the right projection 3*e* parallel to the first tapered surface is equivalent to a second tapered surface. By the elastic force of the movable contact (the return member), the operating body 1 is guided and moved by the first and second tapered surfaces.

The tapered surface 3*e*1 of the projection 3*e* is equivalent to the operating body regulating portion, and the tapered surface 4*c*1 of the concave portion 4*c* is equivalent to the casing regulating portion. As the tapered surface 3*e*1 abuts on the tapered surface 4*c*1, the operating body 1 which has been guided and moved by the first and second tapered surfaces is regulated from moving upward (in a pressed and moved direction).

Although the above description has been made in conjunction with a case in which the operating body 1 is inclined to the right and shifted from the center. However, in a case in which the operating body 1 is inclined to the left and shifted from the center, and the tapered surface 3*e*2 abuts on the tapered surface 4*c*2 of the concave portion 4*c* after the tapered surface 3*e*1 of the projection 3*e* abuts on the tapered surface 4*c*1 of the concave portion 4*c*, since the operating body 1 is guided by the tapered surfaces 3*e*2 and 4*c*2, the tapered surfaces 3*e*1 and 4*c*1 are equivalent to the first and second tapered surfaces, respectively. Also, since the location of the operating body 1 is regulated by the tapered surfaces 3*e*2 and 4*c*2, the tapered surfaces 3*e*2 and 4*c*2 are equivalent to the regulating portions.

In addition, in a case in which the operating body 1 is shifted from the center in the vertical direction in FIG. 2, the tapered surfaces 3*e*3, 4*c*3, 3*e*4 and 4*c*4 are now equivalent to the first and second tapered surfaces, the operating body regulating portion, the casing regulating portion instead of the above-described tapered surfaces 3*e*1, 3*e*2, 4*c*1 and 4*c*2. The detailed description thereof will be omitted because this case is as same as the above description.

According to the present embodiment, since the operating body 1 slides in contact between the tapered surfaces 3*e*1 and 4*c*1 during the return of the operating body 1, an impact noise caused by bouncing is lessened. In addition, since the projection 3*e* abuts on the concave portion 4*c* (the casing regulating portion) to regulate the location of the operating body 1, the operating body 1 can be easily positioned.

Further, the knob 2 (an operating portion) protrudes from the middle of the operating body 1, and the tapered surfaces 3*e*1, 3*e*2, 3*e*3 and 3*e*4 are disposed to face each other with the knob 2 (the operating portion) interposed therebetween. By such construction, the tapered surfaces can be provided to be separated from each other. Thus, the tapered surfaces can stably slide on each other even with a small inclination of the operating body 1.

Since a positioning surface is provided continuously with the tapered surfaces 3*e*1, 3*e*2, 3*e*3 and 3*e*4, the structure for preventing the noise caused during the return of the operating body 1 and the structure for positioning the operating body 1 can be simplified.

Further, the tapered surfaces 3*e*1 and 3*e*2, the tapered surfaces 3*e*3 and 3*e*4, the tapered surfaces 4*c*1 and 4*c*2, and the tapered surfaces 4*c*3 and 4*c*4 respectively define a V-shaped tapered surface. After the slider abuts on one parallel tapered surface, it abuts on the other parallel tapered surface. In such a construction, a V-shaped section can be obtained when the concave portion is cut. Therefore, although the center of the projection is shifted from the center of the concave portion to some degree when the projection is fitted into the concave portion, noise can be prevented from being generated caused during the return of the slider, and the operating body 1 can be surely positioned.

In plan view, the tapered surfaces 3*e*1 and 3*e*2 and the tapered surfaces 3*e*3 and 3*e*4 respectively define a V-shaped tapered surface on a surface orthogonal to the above tapered surfaces in plan view. Therefore, although the center of the projection is shifted from the center of the concave portion to some degree when the projection is fitted into the concave portion, noise can be prevented from being generated during the return of the slider, and the operating body 1 can be surely positioned in any direction in plan view.

Further, since the projection 3*e* (and the concave portion 4*c*) is formed in the shape of a quadrangular pyramid on which tapered surfaces are provided, and the slider 3 is also quadrangular. Therefore, although the slider 3 is shifted from the center in any directions in plan view, the surface contact is made between the tapered surfaces. Thus, the contact between the tapered surfaces is smooth, which is very preferable for the operation.

In addition, although the projection 3*e* (and the concave portion 4*c*) is quadrangular pyramid-shaped in the embodiment, the present invention is not limited thereto, and a conical or triangular pyramid shape may be used.

As for the relation between the projection 3*e* and the concave portion 4*c* and the inclination (displacement) of the slider 3, when the slider 3 returns to its original position, the slider 3 ascends while being inclined by the return member at a position biased as much as clearance. At this time, it is preferable that the location of the leading end 3*ec* of the projection 3*e* of the slider 3 be inside the tapered surfaces of the concave portion 4*c* of the casing 4. It is also preferable that the leading end 3*ec* of the projection 3*e* be formed in the shape of a round surface rather than an angular surface.

Further, although the present embodiment has been described in conjunction with the construction in which the slider 3 is provided with the projection 3*e* and the casing 4 is provided with the concave portion 4*c*, the slider may be provided with a concave portion and the casing may be provided with a projection. Otherwise, the slider may be provided with either of a projection and a concave portion.

Further, in the present embodiment, both of the tapered surfaces of the projection 3*e* and the concave portion 4*c* are formed in the shape of a straight line, and while the surface contact is made between the tapered surfaces, the operating body is guided and regulated in position. However, since the tapered surfaces have only a guiding function, only one of the projection and the concave portion is enough to be the tapered surface. Also, since the regulating portion only determines a position, it need not be the face-to-face appearance.

Further, in the embodiment, as shown in FIG. 2, the quadrangular pyramid-shaped projections are provided at the four corners. As for the deviation in right and left directions in FIG. 2, a pair of projections 3*e* in the upper row and a pair of projections 3*e* in the lower row contribute to the prevention of noise and the positioning. As for the deviation in upward and downward directions in FIG. 2, a pair of projections 3*e* in the right column and a pair of projections 3*e* in the left column contribute to the prevention of noise and the positioning. Therefore, it is possible to stably achieve predetermined functions with a small number of the projections. However, a row of projections are provided in the middle in the left and right directions (between the upper and lower projections 3*e* in FIG. 2), a column of projections are provided in the middle in the vertical direction (between the left and right projections 3*e* in FIG. 2). Otherwise, projections can be provided only in the left and right directions, or only in the vertical direction.

Second Embodiment

Figure 8:
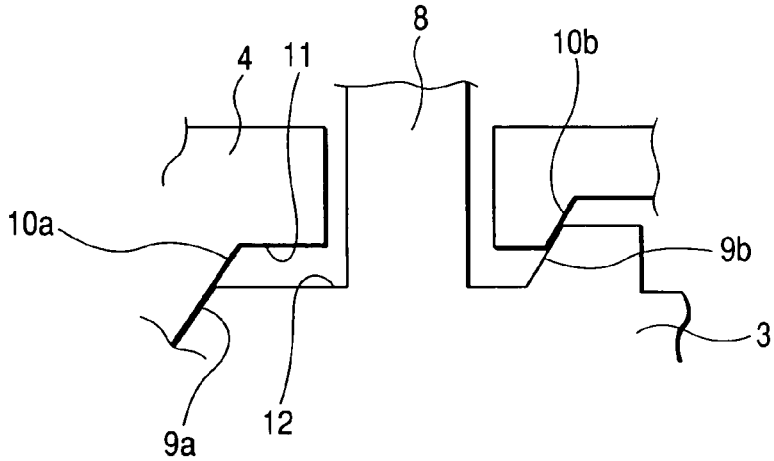
FIG. 8 is a sectional view showing main parts of a push switch related to a second embodiment of the present invention.
Figure 9:
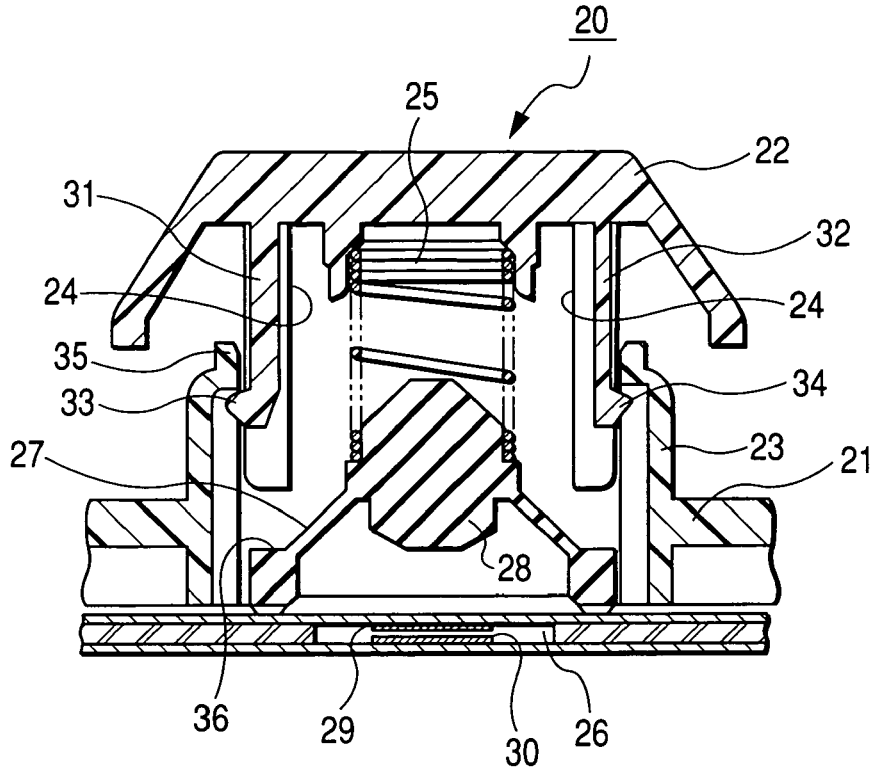
FIG. 9 PRIOR ART
FIG. 9 is a sectional view of a conventional push switch.
Figure 10:
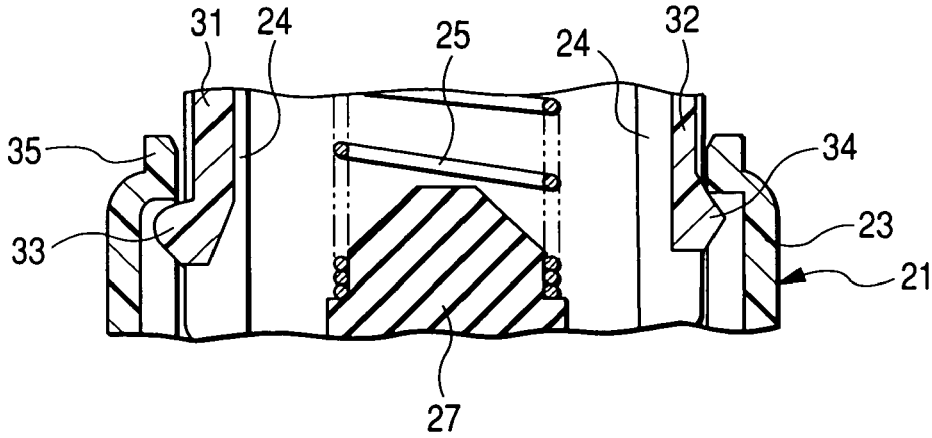
FIG. 10 PRIOR ART
FIG. 10 is a sectional view showing main portion of the push switch shown in FIG. 9.

FIG. 8 is a sectional view showing main parts of a push switch related to a second embodiment of the present invention.

In this embodiment, a tab 8 protrudes from the middle of the slider 3. With respect to the tab 8, a tapered surface 9*a* is provided one side of the slider, and another tapered surface 9*b* parallel to the tapered surface 9*a* is provided on the other side of the slider. These tapered surfaces 9*a* and 9*b* are inclined from the operating direction of the slider 3. Tapered surfaces 10*a* and 10*b* corresponding to the tapered surfaces 9*a* and 9*b* are provided in the casing 4. Also, flat surfaces 11 and 12 are provided.

By these tapered surfaces 9*a*, 9*b*, 10*a* and 10*b*, as the sliding occurs during the return of the slider 3 as described above, the moving speed of the slider 3 is decreased. As a result, generation of an impact noise is prevented. In the present embodiment, the tapered surfaces 9*a* and 10*a* are equivalent to the first tapered surfaces, the tapered surfaces 9*b* and 10*b* to the second tapered surfaces, the flat surface 11 to the casing regulating portion, and the flat surface 12 to the operating body regulating portion.

The construction of the second embodiment which is not described here is as same as the first embodiment.

In addition, while the movable contact of the switch portion 6 is equivalent to the return member, the present invention is not limited thereto. The slider can be returned by the means of an elastic member such as a spring or rubber other than the movable contact.

What is claimed is:

1. A push switch comprising:

an operating body having an operating body regulating portion;

a casing having a guide portion for holding the operating body in a vertically movable manner, and a casing regulating portion for regulating movement of the operating body in a direction opposite to a pressed and moved direction of the operating body by abutting the operating body regulating portion;

a return member which gives an elastic force so as to make the operating body regulating portion abut on a casing regulating portion;

fixed and movable contact which are brought into contact with or separated from each other according to a pressing operation and a releasing operation of the operating body;

a first tapered surface in at least one of the operating body and the casing and inclined from an operating direction of the operating body and a second tapered surface parallel to the first tapered surface; and a gap provided between the casing and the operating body for allowing the operating body to move, wherein during the return of the operating body, the operating body abuts on and is guided by the first tapered surface and the second tapered surface, and then the operating body regulating portion abuts on the casing regulating portion to regulate a position of the operating body in an operating direction.

2. The push switch according to claim 1, wherein an operating portion protrudes from a middle of the operating body, and the first and second tapered surfaces face each other with the operating portion therebetween.

3. The push switch according to claim 1, wherein at least one of the operating body regulating portion and the casing regulating portion is provided continuously with the first and second tapered surfaces.

4. The push switch according to claim 3, the first tapered surface and the operating body regulating portion of the operating body or the casing regulating portion of the casing defines a V-shaped tapered surface, and the operating body and the casing abut on parallel tapered surfaces on one side, and then abut on parallel tapered surfaces on the other side.

5. The push switch according to claim 4, wherein in plan view, a V-shaped tapered surface is defined on a surface orthogonal to the V-shaped tapered surface to form a quadrangular pyramid surface.

* * * * *